United States Patent [19]

Tallerino

[11] Patent Number: 4,834,684

[45] Date of Patent: May 30, 1989

[54] BALL LOCK RELEASE MECHANISM

[75] Inventor: Charles Tallerino, San Diego, Calif.

[73] Assignee: The United States of America as represented by the Secretary of the Navy, Washington, D.C.

[21] Appl. No.: 162,458

[22] Filed: Feb. 1, 1988

[51] Int. Cl.[4] ..... B63B 22/08

[52] U.S. Cl. ..... 441/2; 441/7; 441/24; 441/33

[58] Field of Search ..... 441/2, 6, 7, 23, 24, 441/25, 32, 33

[56] References Cited

U.S. PATENT DOCUMENTS

| | | | |
|---|---|---|---|
| 1,572,142 | 2/1926 | Hood . | |
| 2,736,562 | 2/1956 | Blackburn | 279/76 |
| 2,837,370 | 6/1958 | Stott et al. | 294/83 |
| 3,094,345 | 6/1963 | Gaylord | 287/76 |
| 3,212,110 | 10/1965 | Lombardo | 441/24 |
| 3,622,962 | 9/1969 | Winget | 441/23 |
| 3,631,550 | 1/1972 | Bullen | 441/25 |
| 3,650,182 | 3/1972 | Phillips | 92/128 |
| 3,721,462 | 3/1973 | Pawlitzki | 287/119 |
| 4,571,788 | 2/1986 | Bruengger | 441/33 |

*Primary Examiner*—Sherman D. Basinger
*Assistant Examiner*—Thomas J. Brahan
*Attorney, Agent, or Firm*—Harvey Fendelman; Thomas Glenn Keough

[57] ABSTRACT

An instrumentation package and float are releasably joined to an anchor by a connector that holds the float and anchor together until the anchor impacts the ocean bottom. Upon impact, the inertia of the float and package cause a connector shaft to continue downward motion so that an inwardly biased ball is displaced from a lateral opening in a coaxially located connector housing. After the ball clears the retainer hole and is displaced into a lateral bore in the shaft and after the downward inertial travel of the float and package have stopped, the float pulls the shaft free from the connector housing to suspend the package a predetermined distance below the float via a supporting lanyard. An anchoring lanyard is provided to hold the instrumentation package a predetermined length above the anchor so that it is located a set distance above the ocean bottom.

6 Claims, 2 Drawing Sheets

BALL LOCK RELEASE MECHANISM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

A proper deployment of undersea instrumentation packages which are suspended a distance above the ocean floor creates times for concern for oceanographic data gathers. When strings of weights, instrumentation packages and floats are dropped over the side, or ejected from a submersible, the problems of entanglement and damage of the instrumentation are ever present. Spring-biased release mechanisms which eject anchors and floats can be jammed by sediment or marine fowling, particularly when too long a period has elapsed before the instrumentation is released. Corrosive interconnect links have been used in some applications with some success, however, too much or too little time might pass before a corrosive link is dissolved, so that meaningful data might be missed. In some instances actuations and releases of controlled, remote instrumentation packages have relied on acoustic signals, but this approach can be expensive and reliability might be impaired particularly when actuation is to occur after a prolonged period of inactivity. Maintaining an adequate power supply for responsive actuation, also might create problems where an active or semi-active release mechanism depends on a remotely originating signal.

Thus, a continuing need exists in the state-of-the-art for the deployment of a buoyed instrument package from the ocean floor which does not expose the package to damage during deployment and which reliably operates upon impact with the ocean floor.

SUMMARY OF THE INVENTION

The present invention is directed to providing an apparatus for selectively decoupling a buoyed package from an anchor upon impact with the ocean floor. A tubular housing is secured to the anchor and has a longitudinal bore and a lateral opening communicating with the bore. A rigid sphere is disposed in the lateral opening and is biased to project in the longitudinal bore as a ring-shaped elastomer wrapped about the housing tends to force the sphere into the longitudinal bore. An elongate shaft connected to the buoyed package is sized to enable reciprocable motion in the longitudinal bore, but is restrained from doing so by the engagement of the rigid ball with a cavity in the shaft. When the anchor and buoyed package impact the ocean floor, the inertia of the float and package forces the shaft toward the anchor and allows the rigid ball to be pushed into a lateral bore provided in the shaft. This releases the tubular housing, so that the buoyed package can pull free of the anchor. A lanyard holds the buoyed package a predetermined distance above the anchor and a second lanyard supports the package by a buoy.

A prime object of the invention is to provide a more reliable apparatus for deploying an oceanographic instrumentation package.

Another object of the invention is to provide a decoupling apparatus that operates upon impact with the ocean floor to release a float and instrumentation package from an anchor.

A another object of the invention is to provide an oceanographic release mechanism employing a ball-lock coaction between a tubular housing and a coaxially contained shaft.

Still another object of the invention is to provide for an impact-actuated release mechanism for locating an instrumentation package a predetermined distance above the ocean floor.

Yet a further object of the invention is to provide for an apparatus for releasing an oceanographic instrumentation package of higher reliability due to an uncomplicated design.

These and other objects of the invention will become more readily apparent from the ensuing specification and claims when taken in conjunction with the attached drawings.

DESCRIPTION OF THE PREFERRED EMBODIMENT

Figure 1A:
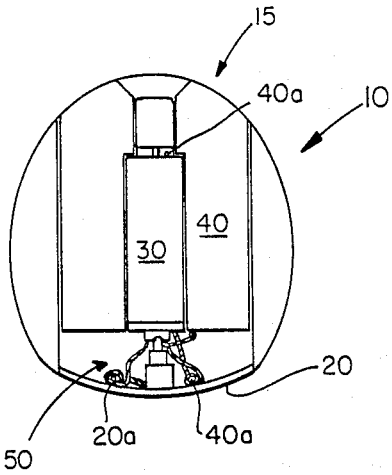
FIGS. 1*a*, 1*b* and 1*c* show the deployment of an instrumentation package relying on the release mechanism.
Figure 1B:
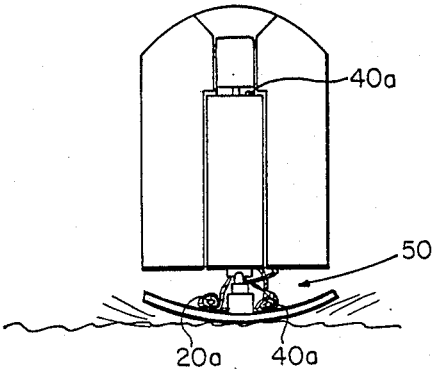
Figure 1C:
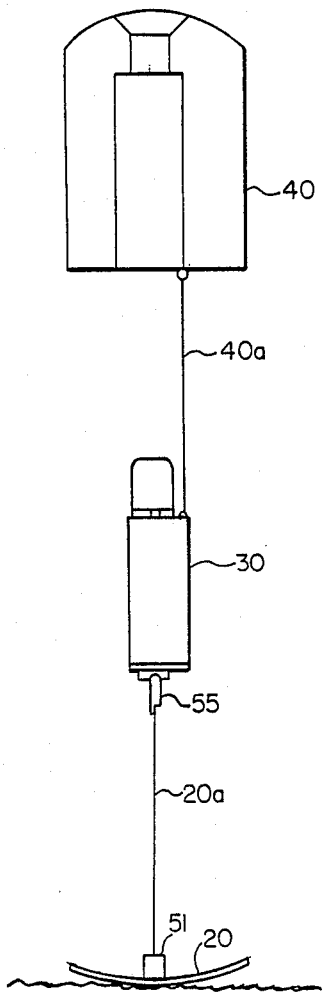

Referring now to FIGS. 1*a* through 1*c*, a surface or sub-surface craft is provided with a cylindrically shaped tube 10 for releasing a buoyed instrumentation package 15. The package has an anchor portion 20, that is configured to conform with the outside of the support craft tube and to provide a streamline shape as the package falls to the bottom of the ocean. Needless to say, the anchor must possess sufficient mass to overcome the buoyancy of an interconnected instrumentation package 30, such as a transponder, and its associated float 40.

After the anchor, instrumentation and float are released from the support vessel by conventional means not shown, they free-fall to the ocean floor as a unit until impact. The impact with the ocean floor results in the separation by tethers 20*a* and 40*a* of the float, instrumentation and anchor due to the coaction of a ball-lock release mechanism 50 that reliably decouples these elements. Release at the moment of impact reduces the changes for entangling the anchor-instrumentation-float combination so that the instrumentation can perform the task assigned it. These tasks can range from functioning as a transponder or the monitoring of some ambient phenomena of interest for scientists and oceanographers.

Due to its uncomplicated, trouble-free design, release mechanism 50 is capable of reliably deploying a sonar transponder from an undersea vehicle in depths approaching 20,000 feet. The hydrodynamically acceptable configuration of the interconnected anchor, instrumentation and float combination provides a proper orientation for release of the instrumentation and float when the combination strikes the ocean floor. The transponder is deployed between the float and anchor for reliable functioning.

Figure 2:
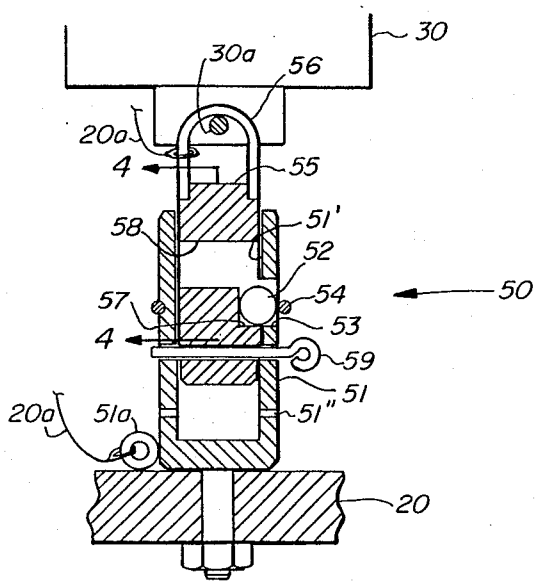
FIG. 2 depicts a cross-sectional view of the invention prior to deployment with a safety pin in place.

Looking to FIG. 2 release mechanism 50 has an essentially tubular shaped housing 51 connected to anchor 20 and a shaft 55 joined to transponder 30 via a pin 30*a* and U-shaped padeye 56 secured on one end of the shaft. Shaft 55 is dimensioned to slidably fit within a longitudinal bore 51' of butular housing 51 and be capable of reciprocal travel within the housing.

Axial or reciprocable motion of the shaft is arrested by a stainless steel ball 52 that is sized to freely pass through a lateral opening 53 in tubular housing 51. The ball also fits within a recess 57 provided in shaft 55 so that the ball jams relative motion between the shaft and tubular housing, when the ball is held to occupy the position shown in FIG. 2. An elastomer O-ring 54 holds the ball in its locking, jamming relationship within lateral opening 53 and recess 55 to hold the anchor, transponder and float together as an integral unit.

A lateral bore 58 is machined in shaft 55 adjacent recess 57, but not in a co-aligned relationship. The bore extends from one side of the shaft to the other and has a diameter slightly in excess of that of ball 52. When lateral bore 58 and lateral opening 53 are laterally aligned, O-ring 54 will move the ball entirely within longitudinal bore 51' to release the shaft from the housing as will be elaborated on below.

A safety pin 59 is included to prevent the premature release of the transponder and float from the anchor during handling and storage aboard the research craft. The safety pin is removed before the anchor-instrumentation-float combination is deployed.

Referring once again to FIG. 1*a* a support craft tube 10 is shown prior to deploying an interconnected anchor-transponder-float 15. It is dropped through the water until it impacts the ocean floor, as shown in FIG. 1*b*. Up to the moment of impact, the release machanism appears substantially as shown in FIG. 2, it being obvious, however, that pin 59 has been removed during deployment and free-fall to the ocean floor.

Figure 3:
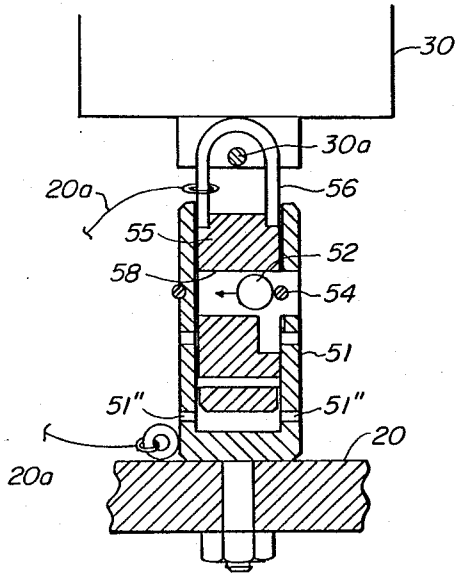
FIG. 3 shows the release mechanism upon impact with the rigid ball in the lateral bore thereby releasing the tubular housing from the shaft.

At the moment of impact, the inertia of float 40 and instrumentation package 30 causes an axial displacement of shaft 55 within tubular housing 51 to assume the relationship shown in FIG. 3. At this precise moment, as lateral bore 58 becomes aligned with lateral opening 53, ball 53 is forced within the lateral bore by O-ring 54. The O-ring forces ball 52 from its interlocking or jamming of the housing and the shaft when the ball was located partially in lateral opening 53 and partially in recess 57.

In the moment after impact, the buoyancy exerted by float 40 pulls shaft 55 free of tubular housing 51. Vent holes 51'' are included in the housing to assure its free-flooding. Float 40 lifts instrumentation package 30, a full length of anchor lanyard 20*a* above anchor 20. The anchor lanyard was carried in a coil on the upper surface of the anchor, see FIG. 1*a*, during free-fall. Lanyard 20*a* is secured to padeye 56 which remains attached to instrumentation package 20 and the other end of lanyard 20*a* is secured to a padeye 51*a* on the tubular housing.

Lanyard 40*a* was coupled to loop about the release mechanism so that when separation occurred between shaft 55 and tubular housing 51, it too was freed to allow a tethered separation of the float and instrumentation package.

Figure 4:
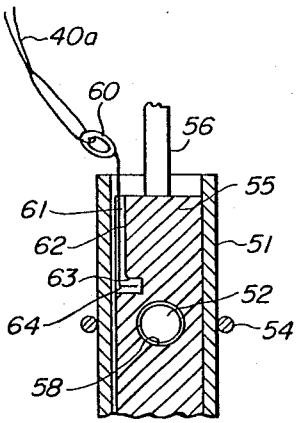
FIG. 4 shows a cross-sectional view of the release mechanism, taken generally along lines 4—4 in FIG. 2.

Referring now to FIG. 4, lanyard 40*a* is held by release mechanism 50 via a retaining loop 60, coupled to a retaining wire 61. Shaft 55 has a longitudinal groove 62 that terminates in a radially inwardly extending hole 63. A bent portion 64 of wire 61 is inserted into the radially extending hole, so that when tubular housing 51 contains shaft 55 (during deployment of the anchor-instrumentation-float combination prior to impact,) wire 61 is retained in the release mechanism and lanyard 40*a* is coupled thereto by loop 60.

When the anchor hits the bottom, the inertia of the float and instrumentation package causes the aforedescribed mechanical coaction and release of the shaft from the tubular housing. As this release occurs, wire 61 falls away from the shaft and the buoyancy of float 40 pulls lanyard 40*a* free to allow the suspension of the instrumentation package below the float a distance equal to the length of the lanyard.

From the foregoing it is apparent that a highly reliable release mechanism is provided which assures the tangle-free deployment of marine instrumentation. Actuation of the release mechanism upon impact avoids the design complications attended corrosive lengths, remotely actuated devices and questionable timing devices.

The constituents of the relese mechanism are machined from corrosion resistant or noncorrosive materials such as stainless steel. Dimensions and fittings are selected in accordance with second marine design principles and strength of material considerations.

Obviously, many modifications and variations of the present invention are possible in the light of the above teachings. It is therefore to be understood that within the scope of the appended claims the invention may be practiced otherwise than as specifically described.

I claim:

1. An apparatus for decoupling a package buoyed from an anchor upon impact with the ocean floor comprising:

means secured to the anchor for providing a longitudinal bore having a lateral opening communicating therewith;

a rigid sphere disposed in the lateral opening and partially extending into the longitudinal bore;

means for resiliently urging the rigid sphere from within the lateral opening to within the longitudinal bore; and means connected to the buoyed package and carried in the longitudinal bore for engaging the rigid sphere during descent to the ocean floor and for releasing the rigid sphere upon impact with the ocean floor, the providing means is a tubular housing and the engaging and releasing means is a shaft sized to be reciprocally slidably carried in the longitudinal bore and is provided with a recess size to receive about one-half of the rigid sphere while the package and anchor are descending and a lateral bore next to, but in nonalignment with the recess having a diameter for receiving the rigid sphere when the inertia of the buoyed package displaces the shaft toward the anchor upon impact with the ocean floor and the resiliently urging means is an elastomer band urging the rigid sphere into the lateral bore when the lateral bore and lateral opening become aligned upon impact.

2. An apparatus according to claim 1 in which the tubular housing and the shaft are aligned with the direction of buoyancy to assure reliability.

3. An apparatus according to claim 2 further including:

a safety pin to hold the tubular housing and shaft together prior to deployment.

4. An apparatus according to claim 3 further including:

a first lanyard connected to the anchor and the buoyed package for locating the buoyed package a predetermined distance above the ocean floor after a selective decoupling has occurred at impact.

5. An apparatus according to claim 4 further including:

a second lanyard coupling a float element and instrumentation of the buoyed package together after a selective decoupling at impact.

6. An apparatus according to claim 5 further including;

a wire loop connected to the second lanyard and carried on the shaft that releases the second lanyard upon the decoupling of the package from the anchor.

* * * * *